US008511430B1

(12) United States Patent
Pelini

(10) Patent No.: US 8,511,430 B1
(45) Date of Patent: Aug. 20, 2013

(54) JACK PLATE LADDER LOCK WITH BUSHING

(76) Inventor: Mark F. Pelini, Valrico, FL (US)

( * ) Notice: Subject to any disclaimer, the term of this patent is extended or adjusted under 35 U.S.C. 154(b) by 73 days.

(21) Appl. No.: 12/931,879

(22) Filed: Feb. 14, 2011

Related U.S. Application Data

(63) Continuation-in-part of application No. 12/586,556, filed on Sep. 24, 2009, now Pat. No. 8,235,174.

(51) Int. Cl.
*E06C 5/00* (2006.01)

(52) U.S. Cl.
USPC ..... 182/82; 182/83; 182/87; 182/93; 182/100; 114/362

(58) Field of Classification Search
USPC ..... 182/82, 83, 85, 87, 93, 100, 107; 403/109.2, 109.3, 365, 377, 378; 114/362
See application file for complete search history.

(56) References Cited

U.S. PATENT DOCUMENTS

| | | | | | |
|---|---|---|---|---|---|
| 372,982 | A * | 11/1887 | Judd | 182/93 |
| 910,527 | A * | 1/1909 | Gilbert | 474/99 |
| 2,947,555 | A * | 8/1960 | Olsen | 403/73 |
| 3,467,418 | A * | 9/1969 | Redditt | 182/229 |
| 3,486,580 | A * | 12/1969 | Norton et al. | 182/214 |
| 3,503,467 | A * | 3/1970 | Lindblad | 182/97 |
| 3,517,184 | A * | 6/1970 | Hale et al. | 362/477 |
| 3,786,899 | A * | 1/1974 | Zenhausern | 182/93 |
| 3,869,742 | A * | 3/1975 | Gale et al. | 114/362 |
| 4,146,941 | A * | 4/1979 | Haslam | 114/362 |
| 4,355,701 | A * | 10/1982 | Nicholson | 182/97 |
| 4,432,436 | A * | 2/1984 | Suiter | 182/97 |
| 4,576,501 | A * | 3/1986 | McConnell | 403/59 |
| 4,892,170 | A * | 1/1990 | O'Donnell | 182/100 |
| 4,926,965 | A * | 5/1990 | Fox | 182/89 |
| 5,014,640 | A * | 5/1991 | Owen, Sr. | 114/362 |
| 5,222,456 | A * | 6/1993 | Friedrich | 114/362 |
| 5,230,198 | A * | 7/1993 | Callies | 52/702 |
| 5,515,806 | A * | 5/1996 | McCabe | 114/362 |
| 5,964,317 | A * | 10/1999 | Lattavo | 182/127 |
| 6,003,633 | A * | 12/1999 | Rolson | 182/127 |
| 6,932,193 | B2 * | 8/2005 | Tombarello | 182/93 |
| 6,945,189 | B1 * | 9/2005 | Garelick et al. | 114/362 |
| 8,006,803 | B2 * | 8/2011 | Guering | 182/100 |
| 2009/0183946 | A1 * | 7/2009 | Prebola | 182/127 |
| 2011/0011675 | A1 * | 1/2011 | Ebbenga et al. | 182/106 |

* cited by examiner

*Primary Examiner* — Alvin Chin Shue
*Assistant Examiner* — Colleen M Chavchavadze
(74) *Attorney, Agent, or Firm* — Edward P. Dutkiewicz

(57) ABSTRACT

An improved ladder containment and lock device, comprising a left component, a right component, and a two piece bushing. There is a locking subassembly and a pair of coupling bolts, for coupling the components of the device. The two piece bushing has a passageway formed there through, with the passageway being angled relative to the right and left components.

8 Claims, 6 Drawing Sheets

FIG 3
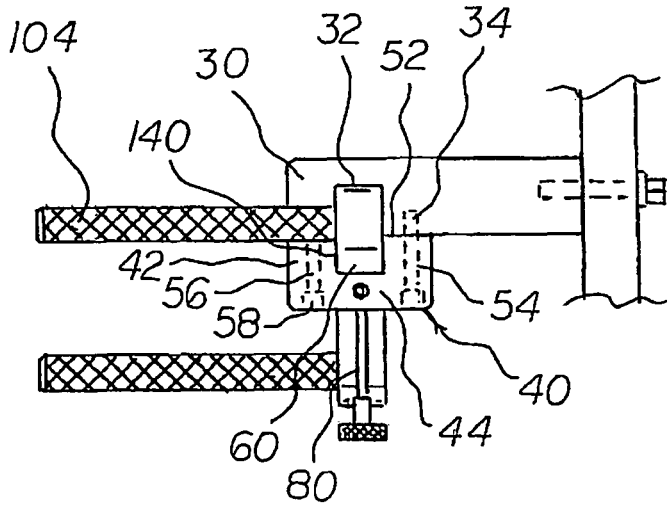
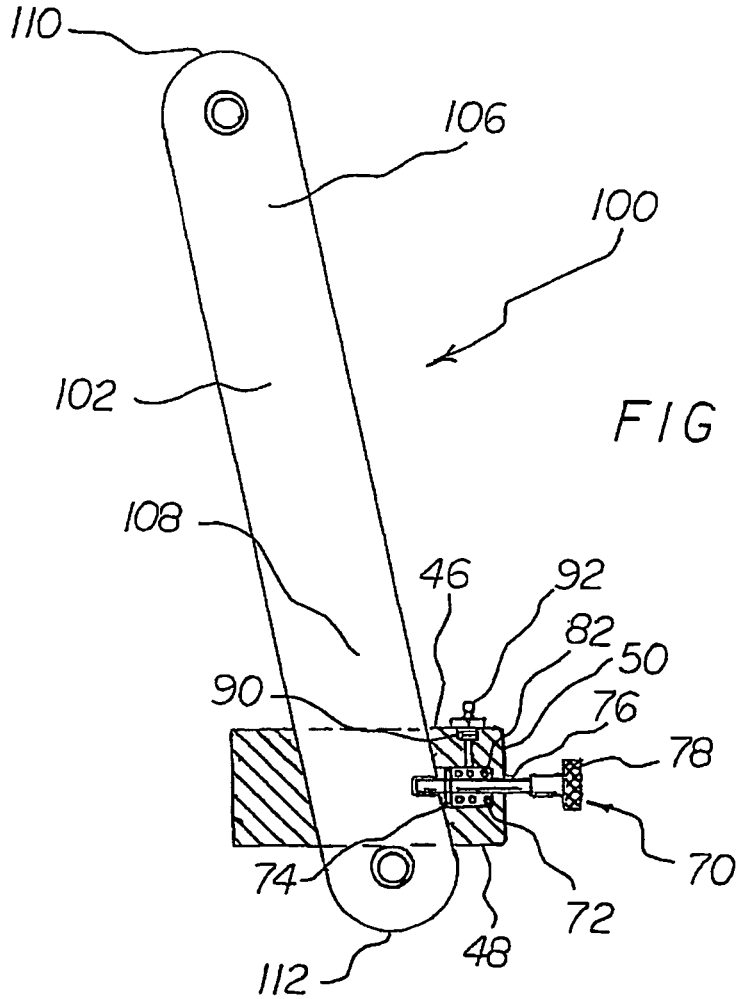
FIG 4

FIG. 7
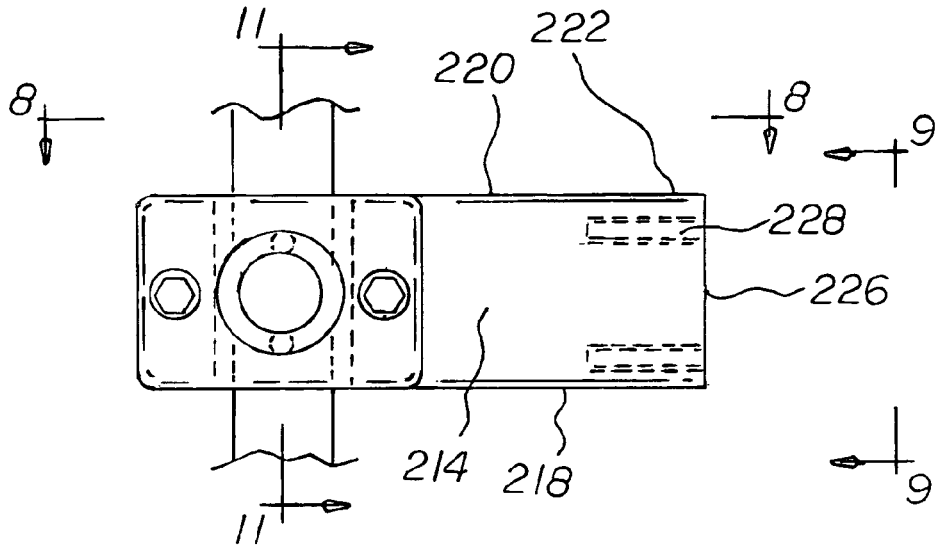
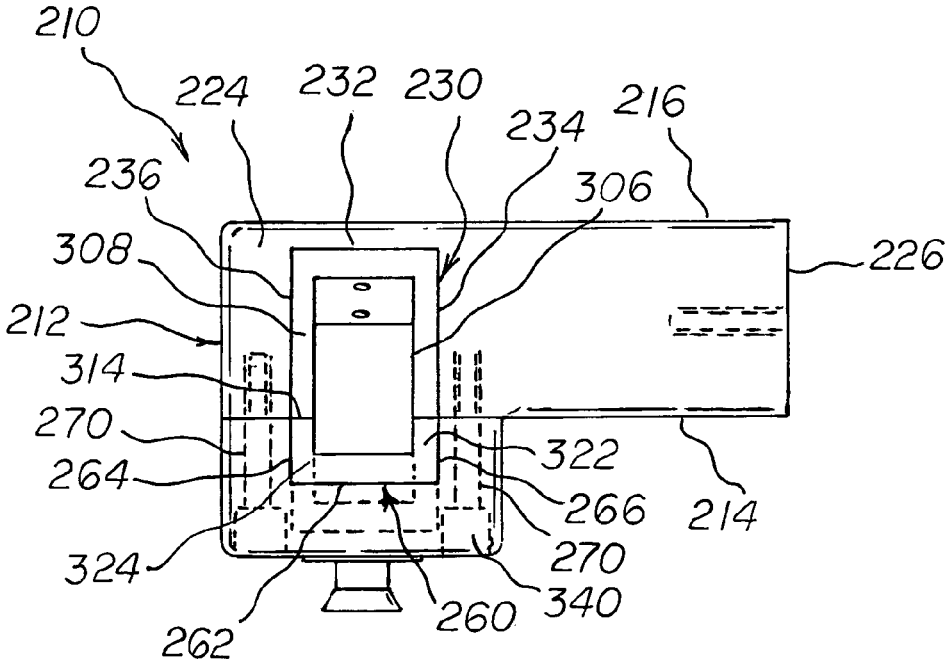
FIG. 8

FIG. 9
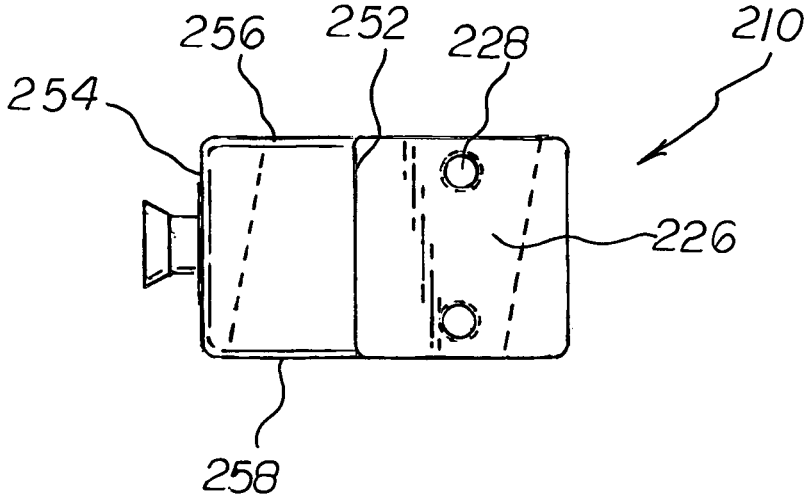
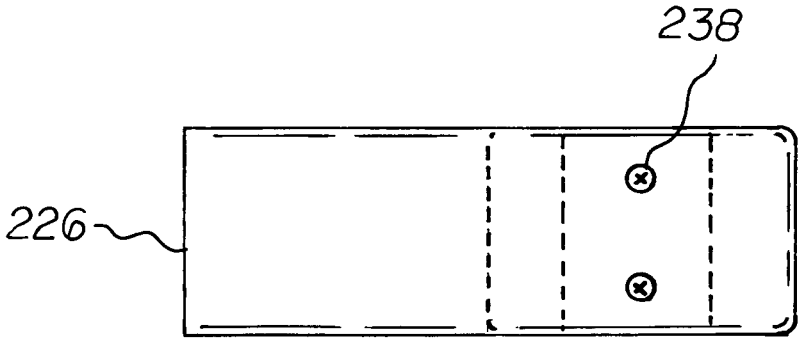
FIG. 10

FIG. 11
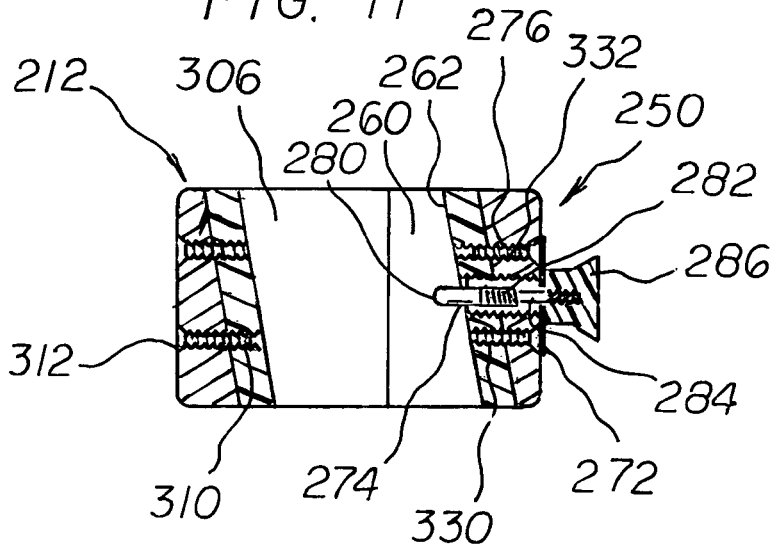
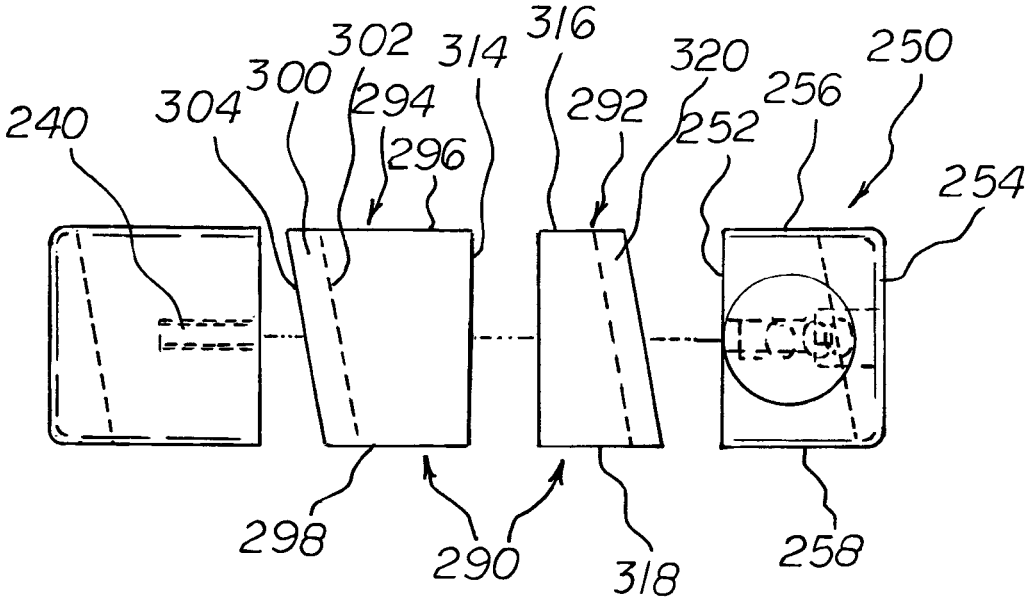
FIG. 12

JACK PLATE LADDER LOCK WITH BUSHING

RELATED APPLICATIONS

The present invention is a continuation-in-part of a currently pending application, bearing Ser. No. 12/586,556, filed on Sep. 24, 2009 now U.S. Pat. No. 8,235,174. The present application claims the priority of the currently pending, above referenced, application.

RULE 1.78(F)(1) DISCLOSURE

The Applicant has not submitted a related pending or patented non-provisional application within two months of the filing date of this present application. The invention is made by a single inventor, so there are no other inventors to be disclosed. This application is not under assignment to any other person or entity at this time.

BACKGROUND OF THE INVENTION

1. Field of the Invention

The present invention relates to a jack plate ladder and more particularly pertains to a slidably movable ladder which is mountable on a jack plate of a boat. The ladder has an associated ladder lock having a bushing.

2. Description of the Prior Art

The use of ladders to enable swimmers to climb into a boat is known in the prior art. More specifically, ladders to enable swimmers to climb into a boat previously devised and utilized for the purpose of ingress and egress of a boat are known to consist basically of familiar, expected, and obvious structural configurations, notwithstanding the myriad of designs encompassed by the crowded prior art which has been developed for the fulfillment of countless objectives and requirements.

While the prior art devices fulfill their respective, particular objectives and requirements, the aforementioned patents do not describe jack plate ladder that is mountable on a jack plate and has a ladder lock with a bushing.

In this respect, the jack plate ladder according to the present invention substantially departs from the conventional concepts and designs of the prior art, and in doing so provides an apparatus primarily developed for the purpose of mounting a ladder on a jack plate with a ladder lock having a bushing.

Therefore, it can be appreciated that there exists a continuing need for a new and improved jack plate ladder which can be mounted on a jack plate, including a jack plate ladder lock with bushing. The ladder lock allows the ladder to be slidably moved through the ladder lock from an upwardly displaced location to a lowered location. In this regard, the present invention substantially fulfills this need.

SUMMARY OF THE INVENTION

In view of the foregoing disadvantages inherent in the known types of ladders to enable swimmers to climb into a boat now present in the prior art, the present invention provides an improved jack plate ladder. As such, the general purpose of the present invention, which will be described subsequently in greater detail, is to provide a new and improved jack plate ladder which has all the advantages of the prior art and none of the disadvantages.

To attain this, the present invention essentially comprises a jack plate and jack plate ladder comprising several components, in combination.

First provided is a jack plate mount. The jack plate mount is fabricated of a rigid material. The jack plate mount has a plate end and a ladder mount end. The plate end has a solid tubular configuration with a generally rectilinear cross sectional configuration. The plate end has an outermost extent, with the outermost extent having a plurality of threaded bolt holes there in. The bolt holes each have an associated bolt and lock washer there with.

The ladder end is continuous with the plate end of the jack plate mount. The ladder end has an outermost extent, with the extent comprising a generally rectilinear solid shaft having a ladder groove therein. The ladder end has a pair of threaded ladder mount bolt holes there in.

There is provided a ladder containment piece. The containment piece has a generally C-shaped configuration, with two short legs each having a first length and a connector having a second length there between. The short legs of the ladder containment are shorter than the connector second length. The ladder containment piece has an upper surface, a lower surface, and a side surface there between. The ladder containment piece also has an inner surface. The side surface of the ladder containment piece has a pair of ladder mount bolt holes there through.

The ladder mount bolt holes run from the side surface of the containment, through the length of the short legs of the containment, to the inner surface of the containment. Each ladder mount bolt hole has an associated ladder mount bolt and an associated lock washer.

The ladder end and the ladder containment are coupled by the ladder mount bolts, thereby forming a generally rectilinear ladder aperture through the ladder end of the jack plate mount.

The containment has an associated lock pin. The lock pin having an associated biasing spring, spring stop, and spring stop pin. The lock pin has a shaft and a knurled gripping knob. The containment has a lock pin aperture there through. The lock pin aperture has an associated spring recess located on the inner surface of the containment. The lock pin aperture runs from the side surface of the containment to the inner surface of the containment, with the lock pin passing through the lock pin aperture.

The containment also has a threaded grease fitting hole located on the upper surface of the containment. The grease fitting hole passes from the upper surface of the containment to the lock pin aperture. The grease fitting hole has an associated grease fitting coupled there to.

There is provided a ladder. The ladder is fabricated of a rigid material. The ladder having a central shaft and a pair of steps. The central shaft has a generally rectilinear configuration, with an upper end and a lower end. The upper end an upper extent and a lower end has a lower extent. The upper end has a step bolt hole there through. The lower end has a step bolt hole there through. The steps each have a generally round tubular construction, with each step having an outer end and an inner end. The outer end of the step has an outer extent and the inner end of the step has an inner extent. The inner extent of each of the steps has a threaded bolt hole there in. Each step has an associated coupling bolt and lock washer. The steps each operatively couple to the ladder central shaft.

The central shaft of the ladder passes through and is contained within the ladder aperture formed by the mount end and ladder containment piece. The lower end of the ladder central shaft has a lock pin recess therein. The lock pin recess engages the lock pin and maintains the ladder in an upwardly displaced and stored orientation. The pulling of the lock pin by the user allows the ladder to fall downward, through the ladder aperture, to a downward, deployed position.

In addition to the above disclosure, a ladder containment and lock device comprises several components, in combination, is further herein described.

First provided is a left component. The left component has a right surface, a left surface; a bottom surface, and a top surface, thereby forming a generally rectilinear shaped component. The top surface and the bottom surface are generally planar and parallel with each other.

The left component has an inward portion, or plate end, and an outward portion, being the ladder mount end. The inward portion has a terminal surface, forming an inward-most extent. The terminal surface of the ladder end has a pair of threaded bolt holes there in.

The inward portion terminal surface of the left component is generally flat and rectilinear in configuration. The outward portion of the left surface of the left component is generally planar. The right surface of the left component has a generally C-shaped configuration, forming a rightwardly angled recess therein.

The rightwardly angled recess has a rightward biased left internal wall. The left internal wall is oriented in a first plane. There is also an inward-most wall and an outward-most wall. The inward-most wall and an outward-most wall are generally parallel and oriented in a second plane, being generally perpendicular to the left internal wall. The recess of the left component has a first inward to outward diameter.

The outward portion of the left surface of the left component has a pair of bolt apertures therein. The right surface of the outward portion of the left component has a pair of threaded bolt holes therein. One of the bolt holes is located outwardly of the recess, and one of the bolt holes is located inwardly of the recess. The bolt holes are generally parallel.

There is next provided a right component, also referred to as the ladder containment piece. The right component has an left surface, a right surface, a top surface, and a bottom surface. The top surface and the bottom surface are generally planar and parallel with each other. The left surface of the right component has a recess therein. The recess forms a generally C-shaped configuration. The recess has a right wall, an outward wall, and an inward wall. The right wall is angled rightwardly and parallel with the first plane. The outward wall and the inward wall are generally parallel with each other and parallel with the second plane. The right wall, the outward wall, and the inward wall form a rightwardly angled recess within the left side of the right component.

The left surface of the right component has a pair of ladder mount bolt holes there through. The ladder mount bolt holes are continuous from the right surface of the right component to the left surface of the right component, passing through the thickness of the right component. The right surface of the right component has a locking subassembly aperture there though. There is a pin aperture running through the right component from the right surface of the right component to the left surface of the right component. The right component has a pair of lock bolt holes there through.

Next provided is a locking subassembly. The locking subassembly comprises a lock pin, a biasing spring, a spring stop, and a spring stop pin. The locking pin has a generally straight shaft and a gripping portion, or knob. The locking subassembly also has a pair of locking bolts. The locking pin has a normally engaged orientation and a withdrawn orientation.

Next provided is a two piece bushing. The two piece bushing has a right component and a left component. The left bushing component has a top surface and a bottom surface. The left bushing component also has a left wall, having an inner surface and outer surface, forming a thickness there between. The left bushing component also has an inward wall, having an inner surface and an outer surface. The left bushing component also has an outward wall, having an inner surface and an outer surface, forming a thickness there between.

The left wall inner surface and the left wall outer surface are each angled rightwardly, relative to the top surface of the bushing. The left wall inner surface and the left wall outer surface are oriented parallel with the first plane.

The left wall has a pair of bolt apertures therein, with the left wall having a pair of associated bushing locking bolts. The bushing locking bolts are positioned so as to pass through the bolt apertures of the left surface of the left component and partially through the thickness of the left wall of the left bushing component.

The inward wall and the outward wall of the left bushing component are each generally parallel to the second plane. The left inward wall and the left wall outward wall each have a terminal surface, with each terminal surface of the left bushing component being generally parallel with each other in a third plane, angled with respect to the left wall of the left bushing component, and generally parallel with the right surface of the left component.

The right bushing component has a top surface and a bottom surface. The right bushing component also has a right wall, the right wall having an inner surface and an outer surface forming a thickness there between. The right bushing component also has an inward wall, having an inner surface and an outer surface, and an outward wall, having an inner surface and an outer surface.

The right wall inner surface and the right wall outer surface are each angled rightwardly, relative to the top surface of the bushing, and oriented parallel with the first plane.

The right wall has a pair of bolt locking bolt apertures there through, with associated locking bolts passing through the right component and partially through the wall thickness of the right wall of the right bushing component, thereby locking the bushing component in place.

The inward wall and the outward wall of the right bushing component are each generally parallel to the second plane, with each having a terminal surface, with each terminal surface of the right bushing component being generally parallel with each other in a third plane, angled with respect to the right wall of the right bushing component, and generally parallel with the left surface of the right component.

Lastly provided is a pair of coupling bolts. The coupling bolts are each configured to pass through the right surface of the right component and through the right component and into the threaded bolt holes of the left component, thereby encasing the right and left bushing components and forming an angled channel there through.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved jack plate ladder which has all of the advantages of the prior art ladders, that is, to enable swimmers to climb into a boat, and none of the disadvantages.

It is another object of the present invention to provide a new and improved jack plate ladder which may be easily and efficiently manufactured and marketed.

It is further object of the present invention to provide a new and improved jack plate ladder which is of durable and reliable constructions.

An even further object of the present invention is to provide a new and improved jack plate ladder which is susceptible of a low cost of manufacture with regard to both materials and labor, and which accordingly is then susceptible of low prices of sale to the consuming public, thereby making such jack plate ladders economically available to the buying public.

Even still another object of the present invention is to provide a jack plate ladder which is mountable on a jack plate.

Lastly, it is an object of the present invention to provide a new and improved jack plate ladder comprising a jack plate mount having a ladder groove, a pair of threaded ladder mount bolt holes, and a pair of threaded plate mounting holes. A ladder containment piece is coupled by a plurality of ladder mount bolts to the jack plate mount and forms a generally rectilinear ladder aperture there through the jack plate mount. A ladder has a central shaft and a pair of steps, the ladder being contained with the ladder aperture.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is view taken along line 3-3 of FIG. 2.

FIG. 4 is a view taken along line 4-4 of FIG. 1.

FIG. 7 is a side view of the improved jack plate ladder containment device having a bushing.

FIG. 8 is a top plan view of the jack plate ladder containment device having a bushing.

FIG. 9 is a front elevational view of the containment device having a bushing.

FIG. 10 is a left elevational view of the device with bushing.

FIG. 11 is a view taken along line 11-11 of FIG. 7.

FIG. 12 is an exploded view of the improved ladder containment device having a bushing.

The same reference numerals refer to the same parts throughout the various Figures.

DESCRIPTION OF THE PREFERRED EMBODIMENT

Figure 1:
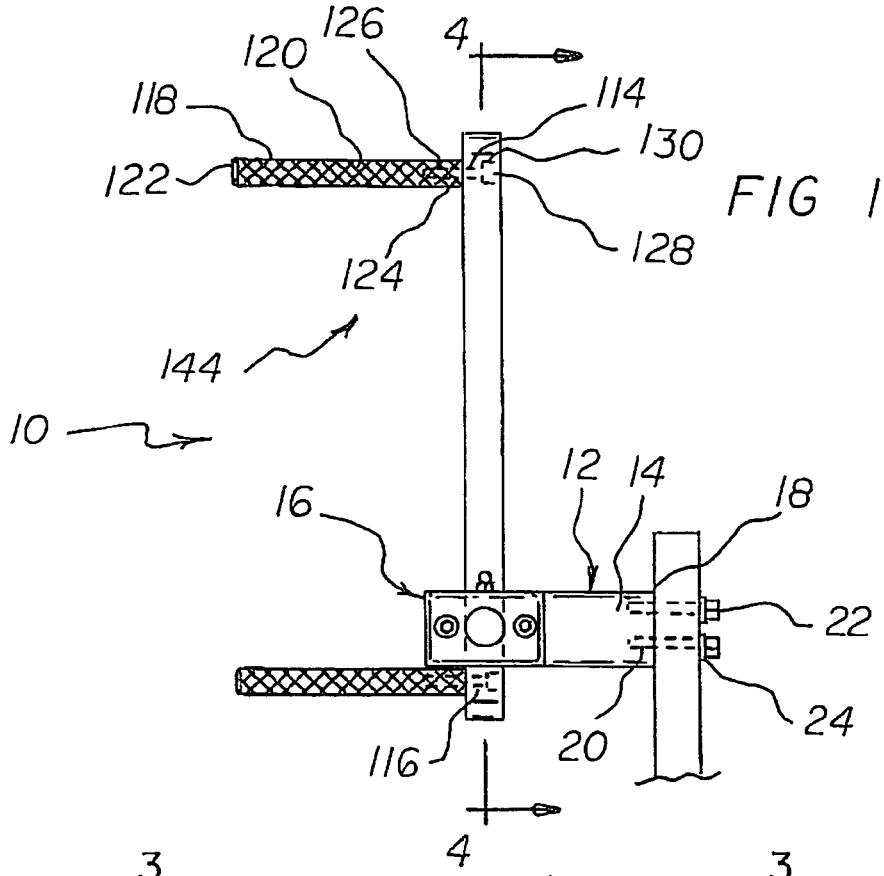
FIG. 1 is a side view of the jack plate ladder, with the ladder in the up and stored, or non-deployed configuration.
Figure 2:
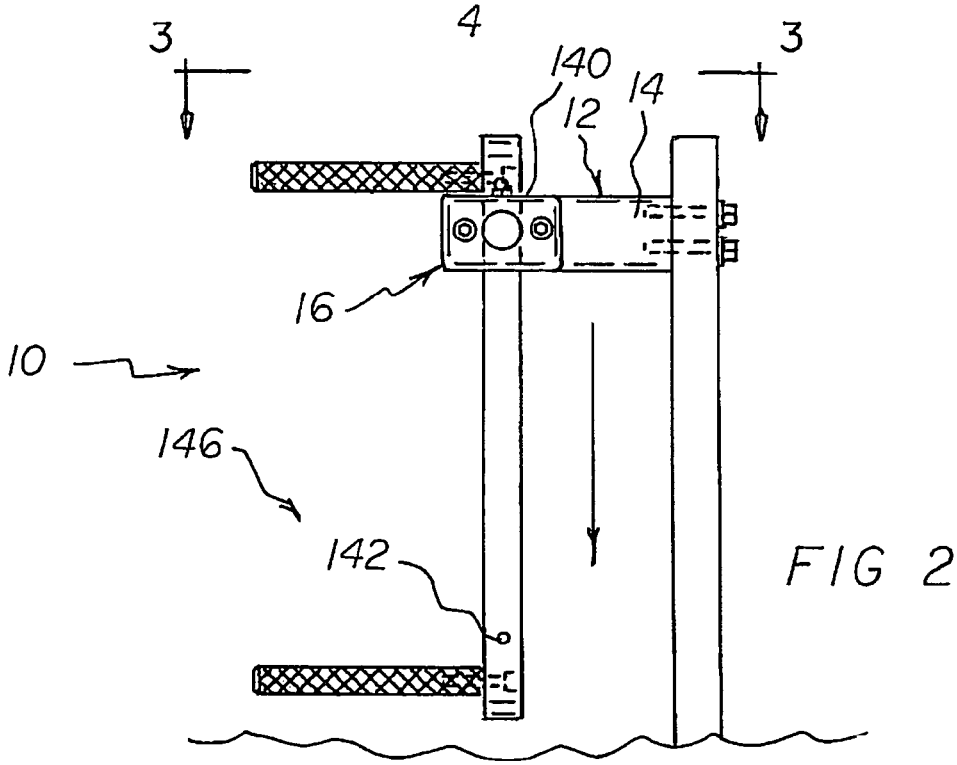
FIG. 2 is a side view of the jack plate ladder, with the ladder in the down and deployed configuration.
Figure 5:
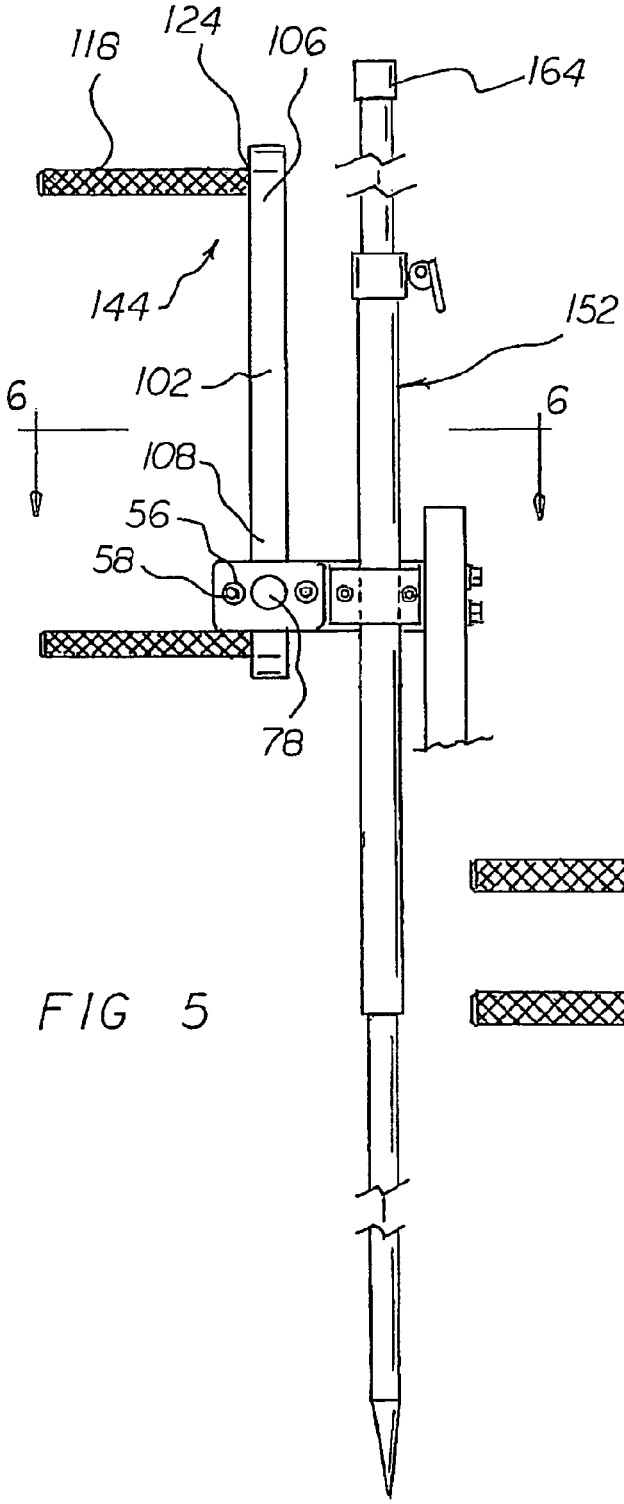
FIG. 5 is a side view of the jack plate ladder with the addition of the pole attachment. The pole attachment is used to anchor the boat in shallow water when fishing.
Figure 6:
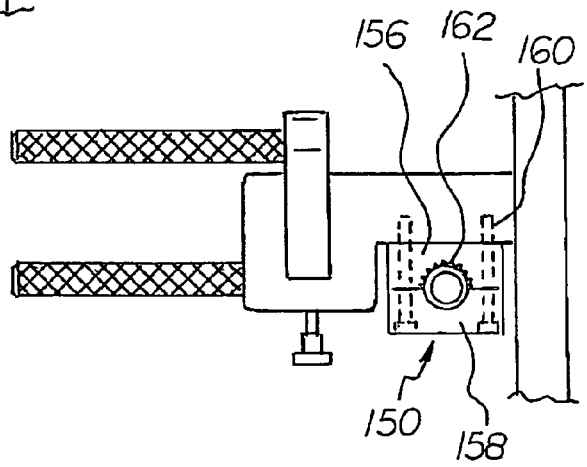
FIG. 6 is a view taken along line 6-6 of FIG. 5.

With reference now to the drawings, and in particular to FIG. 1 thereof, the preferred embodiment of the new and improved jack plate ladder containment device embodying the principles and concepts of the present invention and generally designated by the reference numeral 10 will be described.

The present invention, the jack plate ladder lock with bushing 10 is comprised of a plurality of components. Such components in their broadest context include a jack plate mount, a ladder containment piece and a ladder. Such components are individually configured and correlated with respect to each other so as to attain the desired objective.

The present invention, the jack plate ladder 10 is comprised of a plurality of components. Such components in their broadest context include a jack plate mount, a ladder containment piece and a ladder. Such components are individually configured and correlated with respect to each other so as to attain the desired objective.

First provided is a jack plate mount 12. The jack plate mount is fabricated of a rigid material. The jack plate mount has a plate end 14 and a ladder mount end 16. The plate end has a solid tubular configuration with a generally rectilinear cross sectional configuration. The plate end has an outermost extent 18, with the outermost extent having a plurality of threaded bolt holes 20 there in. The bolt holes each have an associated bolt 22 and lock washer 24 there with.

The ladder end is continuous with the plate end of the jack plate mount. The ladder end has an outermost extent 30, with the extent comprising a generally rectilinear solid shaft having a ladder groove 32 therein. The ladder end has a pair of threaded ladder mount bolt holes 34 there in.

There is provided a ladder containment piece 40. The containment piece has a generally C-shaped configuration, with two short legs 42 each having a first length and a connector 44 having a second length there between. The short legs of the ladder containment are shorter than the connector second length. The ladder containment piece has an upper surface 46, a lower surface 48, and a side surface 50 there between. The ladder containment piece also has an inner surface 52. The side surface of the ladder containment piece has a pair of ladder mount bolt holes 54 there through.

The ladder mount bolt holes run from the side surface of the containment, through the length of the short legs of the containment, to the inner surface of the containment. Each ladder mount bolt hole has an associated ladder mount bolt 56 and an associated lock washer 58.

The ladder end and the ladder containment are coupled by the ladder mount bolts, thereby forming a generally rectilinear ladder aperture 60 through the ladder end of the jack plate mount.

The containment has an associated lock pin 70. The lock pin having an associated biasing spring 72, and spring stop 74. The lock pin has a shaft 76 and a knurled gripping knob 78. The containment has a lock pin aperture 80 there through.

The lock pin aperture has an associated spring recess 82 located on the inner surface of the containment. The lock pin aperture runs from the side surface of the containment to the inner surface of the containment, with the lock pin passing through the lock pin aperture.

The containment also has a threaded grease fitting hole 90 located on the upper surface of the containment. The grease fitting hole passes from the upper surface of the containment to the lock pin aperture. The grease fitting hole has an associated grease fitting 92 coupled there to.

There is provided a ladder 100. The ladder is fabricated of a rigid material. The ladder having a central shaft 102 and a pair of steps 104. The central shaft has a generally rectilinear configuration, with an upper end 106 and a lower end 108. The upper end an upper extent 110 and a lower end has a lower extent 112. The upper end has a step bolt hole 114 there through. The lower end has a step bolt hole 116 there through. The steps each have a generally round tubular construction, with each step having an outer end 118 and an inner end 120. The outer end of the step has an outer extent 122 and the inner end of the step has an inner extent 124. The inner extent of each of the steps has a threaded bolt hole 126 there in. Each step has an associated coupling bolt 128 and lock washer 130. The steps each operatively couple to the ladder central shaft.

The central shaft of the ladder passes through and is contained within the ladder aperture 140 formed by the mount end and ladder containment piece. The lower end of the ladder central shaft has a lock pin recess 142 therein. The lock pin recess engages the lock pin and maintains the ladder in an upwardly displaced and stored orientation 144. The pulling of the lock pin by the user allows the ladder to fall downward, through the ladder aperture, to a downward, deployed position 146.

The jack plate mount may, in a variation of this configuration, have an associated pole mount 150 and pole 152. In this variation, the plate end of the jack plate mount has a pair of threaded bolt holes 154 there into. The pole mount is a two piece pole holder, having a first piece being the base 156, and a second piece being the cap 158. The base has a generally C-shaped configuration, and the cap has a generally C-shaped configuration. The base and the cap each have a pair of continuous bolt holes 160 162 there through. The base and cap form an aperture through the combined mount. The pole, used for anchoring is inserted through the mount. The pole has a cap flange 164, which prevents the pole from falling through the mount aperture.

The improved jack plate ladder containment device 210 comprises several components, in combination.

First provided is a jack plate mount 212. The jack plate mount is fabricated of a rigid material. The jack plate mount has a right surface 214 and a left surface 216 with the left surface having a pair of locking bolt holes there through 238. The jack plate mount has a bottom surface 218 and a top surface 220. The jack plate mount has a plate end 222 and a ladder mount end 224. The plate end has a solid tubular configuration with a generally rectilinear cross sectional configuration. The plate end has an outermost extent, with the outermost extent having a plurality of threaded bolt holes 228 there in. The bolt holes each have an associated bolt and lock washer there with, though not shown.

The ladder end is continuous with the plate end of the jack plate mount. The ladder end has an outermost extent, with the extent comprising a generally rectilinear solid shaft having a ladder groove 230 therein. The ladder groove forms a recess for accepting a bushing therein 232. The recess has a inner extent 234 and an outermost extent 236 The ladder end has a pair of threaded ladder mount bolt holes 240 there in.

There is provided a ladder containment piece 250. The containment piece has a generally C-shaped configuration, with two short legs with each having a first length and a connector having a second length there between. The ladder containment piece has an upper surface 256, a lower surface 258, and a side surface 254 there between. The ladder containment piece also has an inner surface 252. The inner surface of the ladder containment piece has a recess therein 264, with the recess having an outer surface 264 and an inner surface 266. The side surface of the ladder containment piece has a pair of ladder mount bolt holes 270 there through.

The ladder end and the ladder containment are coupled by the ladder mount bolts, thereby forming a generally rectilinear ladder aperture 260 through the ladder end of the jack plate mount, having a rightward-most extent 262.

The ladder mount bolt holes run from the side surface of the containment, through the length of the short legs of the containment, to the inner surface of the containment. Each ladder mount bolt hole has an associated ladder mount bolt 340 and an associated lock washer, not shown, but well known in the art.

Next provided is a locking subassembly. The locking subassembly comprises a locking pin 280 and a biasing spring 282. The locking pin has a generally straight shaft 284 and a gripping portion 286, or knob.

The locking pin has a normally engaged orientation and a withdrawn orientation. In the engaged orientation, the locking pin protrudes through the right bushing. In the withdrawn orientation, the locking pin is withdrawn back, against the biasing spring tension, so that the end of the locking pin does not protrude from the right bushing component, thereby allowing the ladder contained therein to be moved from the deployed orientation to the stored, or non-deployed, orientation.

Next provided is a two piece bushing 290. The two piece bushing has a right component 292 and a left component 294. The left bushing component has a top surface 296 and a bottom surface 298. The left bushing component also has a left wall 300, having an inner surface 302 and outer surface 304, forming a thickness there between. The left bushing component also has an inward wall 306, having an inner surface and an outer surface. The left bushing component also has an outward wall 308, having an inner surface and an outer surface, forming a thickness there between.

The left wall inner surface and the left wall outer surface are each angled rightwardly, relative to the top surface of the bushing. The left wall inner surface and the left wall outer surface are oriented parallel with the first plane.

The left wall of the left bushing component has a pair of bolt apertures 310 therein, with the left wall having a pair of associated bushing locking bolts 312. The bushing locking bolts 272 are positioned so as to pass through the bolt apertures of the left surface of the left component and partially through the thickness of the left wall of the left bushing component.

The inward wall and the outward wall of the left bushing component are each generally parallel to the second plane.

The left wall inward wall and the left wall outward wall each have a terminal surface 314, with each terminal surface of the left bushing component being generally parallel with each other in a third plane, angled with respect to the left wall of the left bushing component, and generally parallel with the right surface of the left component.

The right bushing component has a top surface 316 and a bottom surface 318. The right bushing component also has a right wall 320, the right wall having an inner surface 262 and an outer surface 276 forming a thickness there between. The right bushing component also has an inward wall 322, having an inner surface and an outer surface, and an outward wall 324, having an inner surface and an outer surface.

The right wall inner surface and the right wall outer surface of the right bushing are each angled rightwardly, relative to the top surface of the bushing, and oriented parallel with the first plane.

The right wall has a pair of bolt locking bolt apertures 330 there through, with associated locking bolts 332 passing through the right component and partially through the wall thickness of the right wall of the right bushing component, thereby locking the bushing component in place.

The inward wall and the outward wall of the right bushing component are each generally parallel to the second plane, with each having a terminal surface, with each terminal surface of the right bushing component being generally parallel with each other in a third plane, angled with respect to the right wall of the right bushing component, and generally parallel with the left surface of the right component.

Lastly provided is a pair of coupling bolts 340. The coupling bolts are each configured to pass through the right surface of the right component and through the right component and into the threaded bolt holes of the left component, thereby encasing the right and left bushing components and forming an angled channel there through.

The improvement of the above described ladder containment device is the addition of the beveled bushing and the removal of the grease fitting. The beveled bushing, fabricated of a plastic, lubricious material provides for a decrease in friction between the metal and the plastic bushing. In the previously described containment device, the ladder aluminum contacted the aluminum of the containment device, relying on a grease to reduce friction. This allowed the buildup of corrosion on both metal pieces, thereby increasing friction between the pieces, and reducing ease of motion. Moreover, the plastic is not as prone to corrosion, and therefore reduces the amount of corrosion experienced by the containment device.

Secondly, the presence of grease in an area accessible to the users carried with it a potential for a user carrying grease on his or her hands, or contacting the grease with his or her swimsuit. The removal of the need for grease, by using a bushing made of a material which had a reduced amount of friction between the ladder and the bushing, removes the potential for unwanted grease to ruin swimsuit or clothing fabric.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A ladder containment and lock device, comprising, in combination:

a jack plate mount having a right surface and a left surface with a plate end and a ladder mount end, the right surface having a pair of locking threaded bolt holes therein, the ladder mount end having a rightwardly angled recess therein;

a ladder containment piece having an upper surface and a lower surface and a side surface and an inner surface, the inner surface of the ladder containment piece having a recess therein, the side surface of the ladder containment piece having a pair of ladder mount bolt holes there through;

a locking subassembly being operatively coupled to the ladder containment piece, the locking subassembly comprising a locking pin and a biasing spring;

a two piece bushing having a right component and a left component, the left bushing component having a top surface and a left wall having an inner surface and an outer surface, the left bushing component having a recess therein, with the recess being angled rightwardly relative to the top surface of the bushing, the right bushing component having a top surface and a right wall with the right wall having an inner surface and an outer surface, the right bushing component having a recess therein, with the recess being angled rightwardly relative to the top surface of the bushing, the right bushing component recess having a locking pin aperture there through, the two piece bushing being contained within the recesses of the jack plate mount and ladder containment piece; and, a pair of bolts being configured to couple the jack plate mount and ladder containment piece together, thereby forming an angled passageway there through.

2. The ladder containment and lock device as described in claim 1 with the device further comprising:

the jack plate mount rightwardly angled recess having a rightward biased left internal wall oriented in a first plane and an inward-most wall and an outward-most wall, the inward-most wall and an outward-most wall being generally parallel and oriented in a second plane and being generally perpendicular to the left internal wall;

the ladder containment piece rightwardly angled recess having a rightward biased right internal wall oriented in the first plane and an inward-most wall and an outward-most wall, the inward-most wall and an outward-most wall being generally parallel and oriented in the second plane and being generally perpendicular to the right internal wall;

the locking subassembly pin having a generally straight shaft and a gripping portion;

the left bushing component having a bottom surface, the left wall inner surface and the left wall outer surface forming a thickness there between;

the right bushing component having a bottom surface and the right wall inner surface and right wall outer surface forming a thickness there between; and each of the bolts passing through the right surface of the ladder containment piece and through the ladder containment piece and into the threaded bolt holes of the jack plate mount, thereby encasing the right and left bushing components and forming an angled channel there through, thereby removably coupling the ladder containment piece to the jack plate mount.

3. The ladder containment and lock device as described in claim 2 with the device further comprising:

the recess of the jack plate mount having a first inward to outward diameter, the outward portion of the left surface of the jack plate mount having a pair of through bushing locking bolt apertures therein;

the ladder containment piece upper surface and lower surface being generally planar and parallel with each other, the ladder containment piece having a right surface with the right surface having a pair of through bushing locking bolt apertures therein and a pair of associated locking bolts;

the left bushing component having an inward wall having an inner surface and an outer surface with a thickness there between and an outward wall having an inner surface and an outer surface with a thickness there between; and the right bushing component having an inward wall having an inner surface and an outer surface with a thickness there between and an outward wall having an inner surface and an outer surface with a thickness there between.

4. The ladder containment and lock device as described in claim 3 with the device further comprising:

the jack plate mount top surface and the jack plate mount bottom surface being generally planar and parallel with each other, the jack plate mount having a terminal surface with the terminal surface having a pair of threaded bolt holes there in;

the ladder containment piece having a left surface, the ladder containment piece right surface having a locking subassembly aperture there though, with the subassembly aperture running through the ladder containment piece from the right surface of the ladder containment piece to the left surface of the ladder containment piece;

the bushing locking bolts each pass through the ladder and partially through the wall thickness of the right wall of the right bushing component, the inward wall and the outward wall of the right bushing component each having a terminal surface, with each terminal surface of the right bushing component being generally parallel with each other in a third plane and angled with respect to the right wall of the right bushing component and generally parallel with the left surface of the jack plate mount;

the left bushing component left wall having a pair of locking bolt apertures therein with the left wall having a pair of associated bushing locking bolts, the bushing locking bolts being positioned so as to pass through the bolt apertures of the left surface of the jack plate mount and partially through the thickness of the left wall of the left bushing component, the inward wall and the outward wall of the left bushing component each being generally parallel to the second plane, with each having a terminal surface, with each terminal surface of the left bushing component being generally parallel with each other in a third plane and angled with respect to the left wall of the left bushing component and generally parallel with the right surface of the left component;

the right bushing component right wall having a pair of locking bolt apertures therein with the right wall having a pair of associated bushing locking bolts, the bushing locking bolts being positioned so as to pass through the bolt apertures of the right surface of the right component and partially through the thickness of the right wall of the right bushing component, the inward wall and the outward wall of the right bushing component each being generally parallel to the second plane, with each having a terminal surface, with each terminal surface of the right bushing component being generally parallel with each other in a third plane and angled with respect to the right wall of the right bushing component and generally parallel with the left surface of the ladder containment piece; and the locking subassembly locking pin being movable from a normally engaged orientation to a withdrawn orientation.

5. The ladder containment and lock device as described in claim 3 with the device further comprising:

the jack plate mount pair of threaded coupling bolt holes arranged, with one of the coupling bolt holes being located outwardly of the recess and one of the coupling bolt holes being located inwardly of the recess, with the coupling bolt holes being generally parallel; and the left surface of the ladder containment piece forming a generally C-shaped configuration.

6. The ladder containment and lock device as described in claim 5 with the device further comprising the jack plate mount having a generally C-shaped configuration.

7. The ladder containment and lock device as described in claim 5 with the device further comprising the jack plate mount being generally rectilinear in configuration, the outward portion of the left surface of the jack plate mount being generally planar.

8. The ladder containment and lock device as described in claim 7 with the device further comprising the jack plate mount having a top surface, with the top surface and the bottom surface thereby forming a generally rectilinear shaped component.

* * * * *